US005744441A

United States Patent [19]

Urfer et al.

[11] Patent Number: 5,744,441

[45] Date of Patent: Apr. 28, 1998

[54] ENHANCED PERFORMANCE OF AMPHOTERIC SURFACTANTS

[75] Inventors: Allen D. Urfer, Lansdale; Michael Counts, Bethlehem, both of Pa.

[73] Assignee: Henkel Corporation, Plymouth Meeting, Pa.

[21] Appl. No.: 689,954

[22] Filed: Aug. 16, 1996

Related U.S. Application Data

[63] Continuation of Ser. No. 252,122, Jun. 1, 1994, abandoned.

[51] Int. Cl.[6] ..... C11D 1/94; C11D 3/22; C11D 3/28

[52] U.S. Cl. ..... 510/433; 510/422; 510/423; 510/470; 510/500; 510/501; 510/503

[58] Field of Search ..... 510/422, 423, 510/433, 470, 500, 501, 503

[56] References Cited

U.S. PATENT DOCUMENTS

| | | | |
|---|---|---|---|
| 4,061,603 | 12/1977 | Rubinfeld | 252/548 |
| 4,118,332 | 10/1978 | Apostolatos et al. | 252/107 |
| 4,565,647 | 1/1986 | Llenado | 252/354 |
| 5,242,615 | 9/1993 | Urfer et al. | 252/174.17 |
| 5,286,406 | 2/1994 | Schloz et al. | 252/174.17 |
| 5,370,816 | 12/1994 | Balzer et al. | 252/132 |
| 5,374,369 | 12/1994 | Angevaare et al. | 252/102 |
| 5,449,475 | 9/1995 | Cauwet et al. | 252/174.23 |

*Primary Examiner*—Paul Lieberman
*Assistant Examiner*—Gregory R. Delcotto
*Attorney, Agent, or Firm*—Wayne C. Jaeschke; John E. Drach; Steven J. Trzaska

[57] ABSTRACT

The present invention is directed to a process for forming a hydrotrope which effectively reduces the likelihood of phase separation in a liquid cleaning composition and simultaneously enhancing its cleaning properties by combining an alkyl polyglycoside having the formula I $$R_7O(Z)_a \quad (I)$$

wherein $R_7$ is a monovalent organic radical having from about 6 to about 30 carbon atoms; Z is saccharide residue having 5 or 6 carbon atoms; a is a number having a value from 1 to about 6 and an amphoteric surfactant, in a percent actives ratio of about 1:1.

The amphoteric surfactants to be used are preferably selected from the group consisting of N-alkyl beta-alanines, amino betaines, amido betaines, imidazoline betaines, amino oxides, as well as mixtures thereof.

20 Claims, 1 Drawing Sheet

ENHANCED PERFORMANCE OF AMPHOTERIC SURFACTANTS

This application is a continuation of application Ser. No. 08/252,122 filed on Jun. 1, 1994 now abandoned.

BACKGROUND OF THE INVENTION

1. Field of the Invention

The present invention generally relates to a surfactant mixture having enhanced hydrotroping and cleaning properties and a method for maing the same. More particularly, by combining an alkyl polyglycoside with an amphoteric surfactant, a more cost effective surfactant mixture having enhanced hydrotroping and cleaning properties can be formed.

2. Description of the Related Art

Detergents are substances used to remove soil from materials with water. Since detergents are used under such different conditions, e.g., type of soil, material to be cleaned, water temperature, etc., it is not surprising that many different types of detergents are available. One class of detergents are the bar soaps, liquid soaps, and liquid shampoos used for personal cleaning. A second class of detergents are the "light-duty" liquids and powders used for dishwashing and miscellaneous household cleaning. A third class of detergents are the "heavy duty" liquids and powders primarily used for cleaning clothes in washing machines.

All detergents contain at least one surfactant. A surfactant is a substance having molecules which contain both hydrophilic and oleophilic groups. The surfactants are primarily responsible for the soil-removing properties of the detergent, although many other components of the detergent augment the surfactants. Surfactants are routinely classified according to their electrostatic charge: the nonionics possess no net electrostatic charge, the anionics possess a negative charge, the cationics possess a positive charge, and the amphoterics possess both positive and negative charges.

Most detergents, contain many other substances in addition to the surfactants. Some detergents contain builders which aid the soil-removing properties of the surfactants in several ways. In particular, builders help prevent the formation of insoluble soap deposits, aid in soap suspension, and help prevent the precipitation of certain calcium and magnesium salts. Some detergents employ hydrotropes to reduce their viscosity and to prevent phase separation. Fillers are used in some detergents to control density and improve flow properties. Many heavy-duty detergents contain anti-redeposition agents to help prevent redeposition of soil on the clothes. Other ingredients commonly found in detergents are perfumes, corrosion inhibitors, pH adjusters or buffers, dyes or colorings, optical brighteners, foam control agents, bleaches, opacifiers, and stabilizers. Most types of detergents are sold both as powders and as liquids. Although some powders are prepared by mixing together dry ingredients, the vast majority of powders are prepared by drying an aqueous slurry of ingredients. The popularity of the liquids continues to increase, primarily because of their convenience to the consumer, but also because of the savings associated with eliminating the drying step. However, the powdered heavy-duty detergents still outsell the liquid heavy-duty detergents because there continues to be difficulty in formulating a heavy-duty liquid which cleans as well as a powder. The powders generally contain rather large amounts of builders to improve the performance of the surfactants. Unfortunately, the most effective builders have relatively low water solubilities and are used, if at all, in relatively small amounts in the liquids. To compensate for the absence or low level of builder, detergent manufacturers have tried to increase the level of surfactants in the liquids. However, the level of surfactants is limited by viscosity and problems of phase separation. Many detergent manufacturers have attempted to improve the physical properties of their heavy-duty liquids by including hydrotropes in their formulations.

The term hydrotrope is commonly used in the detergent industry to refer to a substance which reduces viscosity and prevents phase separation. It is widely believed that hydrotropes cause this effect by coupling dissimilar molecules and by increasing solubilities of other components. Hydrotropes need not be surface active themselves and do not need to form micelles to effect their action. The effect of hydrotropes on the physical properties of aqueous liquid detergents is discussed more fully in Matson, T. P. and Berretz, M., "The Formulation of Non-Built Heavy-Duty Liquid: The Effect of Hydrotropes on Physical Properties" Soap/Cosmetics/Chemical Specialties, pp. 33 et seq. (November 1979) and pp. 41 et seq. (December 1979).

Commonly used hydrotropes in detergents include ethanol and sodium xylene sulfonate. Ethanol is very effective in a wide range of detergent formulations. However, it is not without disadvantages. For example, its odor (especially of the non-food grades) is difficult to mask with fragrances, it is an explosion hazard to the manufacturer, it is very volatile and requires the consumer to keep the detergent containers sealed to prevent evaporation, and the food-grades are relatively expensive and require special permits, licenses, etc. Sodium xylene sulfonate is relatively inexpensive and is compatible with a wide range of detergent ingredients, but becomes relatively ineffective at higher surfactant levels. Monoethanolamine, diethanolamine, and triethanolamine are occasionally used in liquid detergents to reduce viscosity, but they are not true hydrotropes since they do not couple and, therefore, do not prevent phase separation. A number of organic and inorganic salts are used as hydrotropes in detergent compositions, but they tend to be very selective in the compositions in which they function.

Another class of surfactants which have been found to exhibit exceptional hydrotroping properties in liquid detergent formulations are the previously mentioned amphoterics. These particular surfactants, which contain both a positive and a negative charge, impart hydrotroping and foaming properties to detergent compositions without the above-mentioned incident drawbacks. However, these amphoteric surfactants, while exhibiting excellent hydrotroping and cleaning properties, are very expensive to use and consequently not considered cost-effective. Therefore, a primary object of this invention was to obtain a cost effective surfactant mixture having enhanced hydrotroping properties at high surfactant and builder levels.

It is well-known that certain alkyl glycosides are surface active and are useful as nonionic surfactants in detergent compositions. The alkyl glycosides exhibiting the greatest surface activity have relatively long-chain alkyl groups. These alkyl groups generally contain about 8 to 25 carbon atoms and preferably about 10 to 14 carbon atoms.

Long-chain alkyl glycosides are commonly prepared from saccharides and long-chain alcohols. However, unsubstituted saccharides, such as glucose, and long-chain alcohols are insoluble and do not react together easily. Therefore, it is common to first convert the saccharide to an intermediate, lower alkyl glycoside which is then reacted with the long-chain alcohol. Butyl glycoside is often employed as the intermediate. Since the lower alkyl glycosides are not as surface active as their long-chain counterparts, it is generally desired to reduce their concentration in the final product as much as possible.

SUMMARY OF THE INVENTION

Other than in the operating examples, or where otherwise indicated, all numbers expressing quantities of ingredients or reaction conditions used herein are to be understood as modified in all instances by the term "about".

The general object of this invention is to provide a surfactant mixture having exceptional hydrotroping properties. The more particular objects are to provide such a surfactant mixture which is inexpensive, non-toxic, non-volatile, and effective in many detergent compositions.

Accordingly, it has surprisingly been found that a synergism exists between alkyl polyglycoside and amphoteric surfactants. By combining an alkyl polyglycoside with an amphoteric surfactant, the combination reduces the likelihood of phase separation in an aqueous liquid cleaning composition, is compatible with a variety of organic and inorganic components, is effective at high surfactant concentration levels and can be formed relatively inexpensively. The alkyl polyglycoside to be used is of the general formula I $$R_7O(Z)_a \quad (I)$$

wherein $R_7$ is a monovalent organic radical having from about 6 to about 30 carbon atoms; Z is saccharide residue having 5 or 6 carbon atoms; a is a number having a value from 1 to about 6.

The amphoteric surfactant to be employed, is of the general formula II

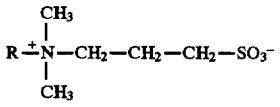

(II)

wherein R is a $C_{8-18}$ alkyl group or having the general formula III

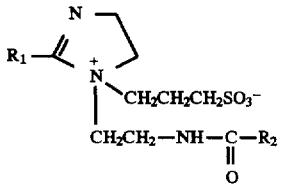

(III)

wherein each of $R_1$ and $R_2$ is a $C_{8-18}$ alkyl group. The following amphoteric surfactants may also be employed in accordance with the present invention:

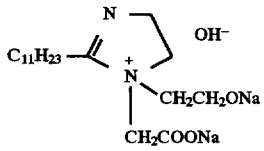

Miranol ® CM

-continued

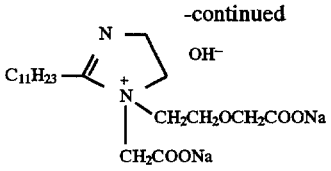

Miranol ® C2M

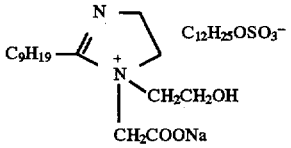

Miranol ® MSA

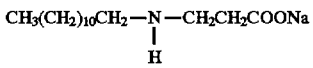

Deriphat ® 115

In a preferred embodiment of the invention, the amphoterics are selected from the group consisting of N-alkyl-beta-alanines, amino betaines, amido betaines, imidazoline betaines, amine oxides and mixtures thereof.

DETAILED DESCRIPTION OF THE INVENTION

Figure 1:
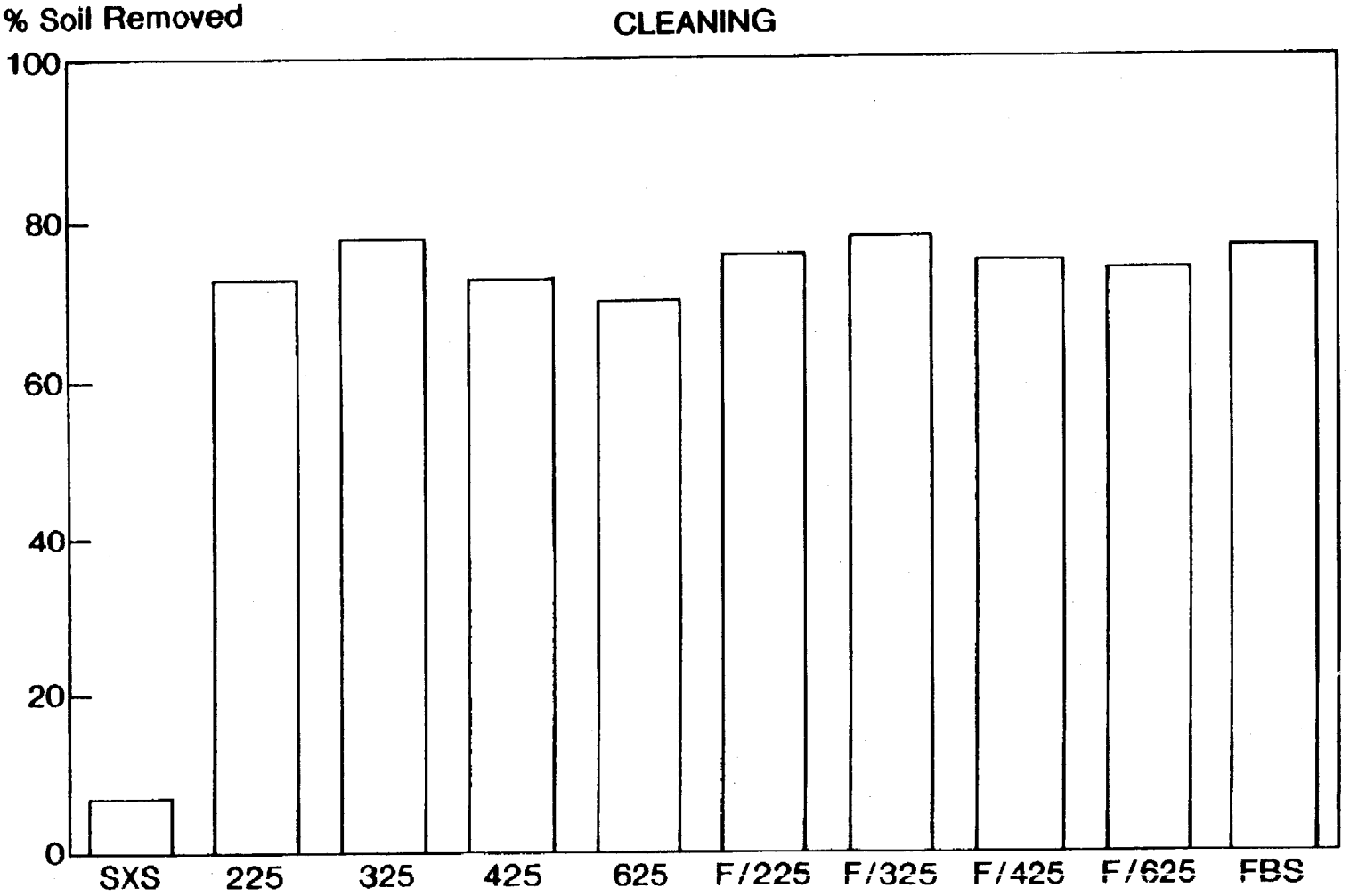
FIG. 1 is a bar graph illustrating the percentage of ASTM A3 soil removed from white vinyl tiles, as determined using the Gardner Abrasion apparatus at 0.6% actives.

Aqueous liquid cleaning compositions are typically formulated with at least one surfactant with the choice of surfactant depending on the intended usage of the cleaning composition and on the other components in the detergent. The most widely used type of surfactant in cleaning compositions are the anionics. The more common anionics include the sulfonates, the sulfates, the ethoxy sulfates, the carboxylates and the phosphates. The second most qwidely used surfactants are the nonionics. The more common nonionics include the ethoxylates, such as ethoxylated alcohols, ethoxylated alkylphenols, ethoxylated carboxylic esters and ethoxylated carboxylic amides. Cationic surfactants, such as the amides and the quaternary ammonium salts, as well as amphoteric surfactants are used less frequently in cleaning compositions. In general, the anionics and nonionics comprise more than about 90 weight percent of the surfactants present in aqueous liquid cleaning compositions.

Carboxylate, sulfonate, sulfate, and phosphate are the polar, solubilizing groups found in anionic surfactants. In dilute solutions of soft water, these groups are combined with a $C_{12}$-chain hydrophobe for optimum surfactant properties. In neutral or acidic media, or in the presence of heavy metal salts, the carboxylate group loses most of its solubilizing power.

Of the cations (counterions) associated with polar groups, sodium and potassium impart water solubility, whereas calcium, barium and magnesium promote oil solubility. Ammonium and substituted ammonium ions provide both water and oil solubility. Triethanolammonium is a commercially important example. Salts of these ions are often used in emulsification.

In general, higher ionic strength of the medium depresses the surfactants solubility. In order to compensate for the loss of solubility, shorter hydrophobes are used for application in high ionic strength media.

The solubilizing group of a cationic surfactant carries a positive charge when dissolved in an aqueous medium. The positive charge resides on an amino or quaternary nitrogen. A single amino nitrogen is sufficiently hydrophilic to solubilize a detergent-range hydrophobe in dilute acidic solution; e.g. laurylamine is soluble in dilute hydrochloric acid. For increased water solubility, additional primary, secondary or tertiary amino groups can be introduced or the amino nitrogen can be quaternized with low molecular weight alkyl groups such as methyl or hydroxyethyl. Quaternary nitrogen compounds are strong bases that form essentially neutral salts with hydrochloric and sulfuric acids. Most quaternary nitrogen surfactants are soluble even in alkaline aqueous solutions. Polyoxyethylated cationic surfactants behave like nonionic surfactants in alkaline solutions and like cationic surfactants in acid solutions.

Amphoteric surfactants are those which contain both an acidic and a basic hydrophilic group. These ionic functions may be based on the anionic or cationic groups discussed above. In addition, ether or hydroxyl groups may also be present to enhance the hydrophilicity of the surfactant molecule.

Amphoteric surfactants, due to their high cost as compared to other hydrotroping surfactants, are generally considered specialty surfactants. Amphoteric surfactants have been found to possess excellent surfactant properties for the following reasons: they do not irritate skin or eyes; they exhibit good surfactant properties over a wide pH range; and they are compatible with the above-disclosed anionic and cationic surfactants.

One example of such surfactants are amphoteric imidazolinium derivatives which are prepared from 2-alkyl-1-(2-hydroxyethyl)-2-imidazolines and sodium chloracetate. Imidazolinium derivatives are recommended for use as detergents, emulsifiers, wetting and hair conditioning agents, foaming agents, fabric softeners, and antistatic agents. There is evidence that in cosmetic formulations, certain imidazolinium derivatives reduce eye irritation caused by sulfate and sulfonate surfactants present in these products.

The amphoteric surfactants to be employed in the present invention are of the general formula II

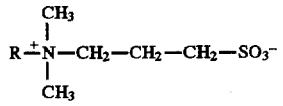

(II)

wherein R is a $C_{8-18}$ alkyl group or having the general formula III

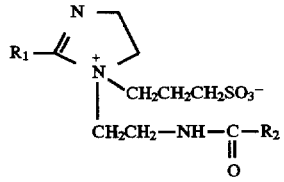

(III)

wherein each of $R_1$ and $R_2$ is a $C_{8-18}$ alkyl group.

Other types of amphoteric surfactants which may also be employed in accordance with the present invention include:

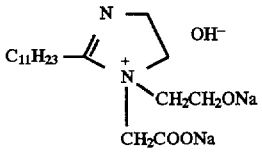

Miranol ® CM

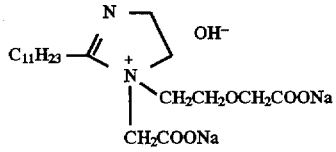

Miranol ® C2M

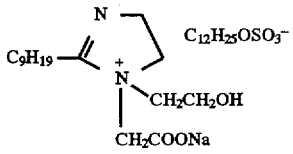

Miranol ® MSA

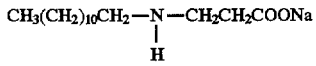

Deriphat ® 115 wherein each of $R_1$ and $R_2$ is a $C_{8-18}$ alkyl group.

In one embodiment of the present invention, the amphoteric surfactant is selected from the group consisting of an N-alkyl-beta-alanine, such as Deriphat® 115 surfactant, which are trademark products of Henkel Corporation, Ambler, Pa., 19002; an amino betaine; an amido betaine; an imidazoline betaine: an amine oxide and mixtures thereof. It should be noted, however, that other amphoteric surfactants may also be employed without departing from the spirit of the invention.

The alkyl polyglycosides to be employed in the present invention are of the general formula I $$R_7O(Z)_a \quad (I)$$

wherein $R_7$ is a monovalent organic radical having from about 6 to about 30 carbon atoms; Z is saccharide residue having 5 or 6 carbon atoms; a is a number having a value from 1 to about 6. The alkyl polyglycosides which can be used in the compositions according to the invention have the formula I and are commercially available, for example, as APG®, Glucopon®, or Plantaren® surfactants from Henkel Corporation, Ambler, Pa., 19002. Examples of such surfactants include but are not limited to:

1. APG® 225 Surfactant—an alkylpolyglycoside in which the alkyl group contains 8 to 10 carbon atoms and having an average degree of polymerization of 1.7.
2. APG® 425 Surfactant—an alkyl polyglycoside in which the alkyl group contains 8 to 16 carbon atoms and having an average degree of polymerization of 1.6.
3. APG® 625 Surfactant—an alkyl polyglycoside in which the alkyl groups contains 12 to 16 carbon atoms and having an average degree of polymerization of 1.6.
4. APG® 325 Surfactant—an alkyl polyglycoside in which the alkyl groups contains 9 to 11 carbon atoms and having an average degree of polymerization of 1.6.
5. Glucopon® 600 Surfactant—an alkyl polyglycoside in which the alkyl groups contains 12 to 16 carbon atoms and having an average degree of polymerization of 1.4.

6. Plantaren® 2000 Surfactant—a $C_{8-16}$ alkyl polyglycoside in which the alkyl group contains 8 to 16 carbon atoms and having an average degree of polymerization of 1.4.
7. Plantaren® 1300 Surfactant—a $C_{12-16}$ alkyl polyglycoside in which the alkyl groups contains 12 to 16 carbon atoms and having an average degree of polymerization of 1.6.

Other examples include alkyl polyglycoside surfactant compositions which are comprised of mixtures of compounds of formula I wherein Z represents a moiety derived from a reducing saccharide containing 5 or 6 carbon atoms; a is zero; and $R^1$ is an alkyl radical having from 8 to 20 carbon atoms. The compositions are characterized in that they have increased surfactant properties and an HLB in the range of about 10 to about 16 and a non-Flory distribution of glycosides, which is comprised of a mixture of an alkyl monoglycoside and a mixture of alkyl polyglycosides having varying degrees of polymerization of 2 and higher in progressively decreasing amounts, in which the amount by weight of polyglycoside having a degree of polymerization of 2, or mixtures thereof with the polyglycoside having a degree of polymerization of 3, predominate in relation to the amount of monoglycoside, said composition having an average degree of polymerization of about 1.8 to about 3. Such compositions, also known as peaked alkyl polyglycosides, can be prepared by separation of the monoglycoside from the original reaction mixture of alkyl monoglycoside and alkyl polyglycosides after removal of the alcohol. This separation may be carried out by molecular distillation and normally results in the removal of about 70–95% by weight of the alkyl monoglycosides. After removal of the alkyl monoglycosides, the relative distribution of the various components, mono- and poly-glycosides, in the resulting product changes and the concentration in the product of the polyglycosides relative to the monoglycoside increases as well as the concentration of individual polyglycosides to the total, i.e. DP2 and DP3 fractions in relation to the sum of all DP fractions. Such compositions are disclosed in copending application Ser. No. 07/810,588, filed on Dec. 19, 1991, the entire contents of which are incorporated herein by reference.

In one embodiment, the present invention relates to a process for making a surfactant mixture which provides exceptional hydrotroping properties, while at the same time enhancing the cleaning properties of an aqueous liquid cleaning composition. The process involves combining an effective amount of an alkyl polyglycoside having formula I $$R_7O(Z)_a \qquad \text{(I)}$$

wherein $R_7$ is a monovalent organic radical having from about 6 to about 30 carbon atoms; Z is saccharide residue having 5 or 6 carbon atoms; a is a number having a value from 1 to about 6, with an amphoteric surfactant having general formula II

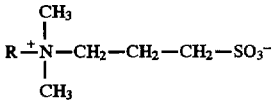

(II)

wherein R is a $C_{8-18}$ alkyl group or having the general formula III

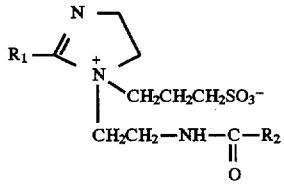

(III)

wherein each of $R_1$ and $R_2$ is a $C_{8-18}$ alkyl group.

Other types of amphoteric surfactants which may also be employed in accordance with the present invention include:

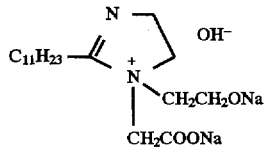

Miranol ® CM

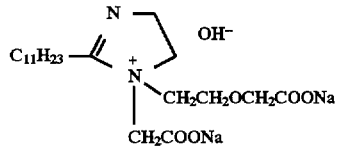

Miranol ® C2M

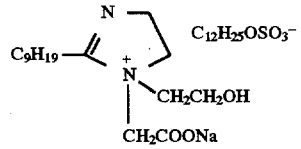

Miranol ® MSA

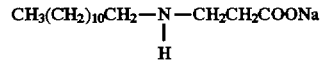

Deriphat ® 115

Particularly preferred amphoteric surfactants include amino betaines, amido betaines imidazoline betaines, amine oxides, as well as mixtures thereof.

The amino betaines which may be employed as the amphoteric surfactant are of the formula IV:

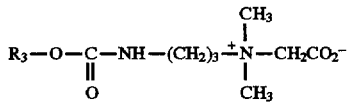

(IV)

wherein $R_3$ is a $C_8$–$C_{18}$ alkyl group.

The amido betaines are represented by the formula V:

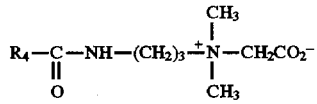

(IV)

wherein $R_4$ is a $C_8$–$C_{18}$ alkyl group.

The imidazoline betaines to be used in the present invention have the formula VI:

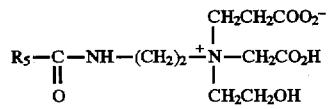

(VI)

wherein $R_5$ is a $C_8$–$C_{18}$ alkyl group.

The amine oxides which may be employed have the formula:

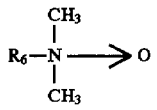

(VII)

wherein $R_6$ is a $C_8$–$C_{18}$ alkyl group.

In a particularly preferred embodiment of the present invention, the amphoteric surfactant used is an imidazoline betaine and more particularly, a substituted coco-imidazoline dicarboxylate formed by reacting coco fatty acids with 2-[(2-aminoethyl)amino]ethanol bis(2-carboxyethyl) derivatives together with disodium salts. This particular type of amphoteric surfactant may be obtained from Rhone-Poulenc under the trade name Miranol®FBS, and from Lonza under the trade name Amphoterge®K-2. The amount of alkyl polyglycoside and amphoteric surfactant to be mixed is dependant on the percent actives of the respective components. In a particularly preferred embodiment, the ratio of alkyl polyglycoside to amphoteric surfactant, based on the percent actives of the two components, is in the range of about 0.5:1 to about 3:1, and preferably about 1:1. Also, the pH of the newly formulated surfactant mixture is adjusted to a range of from about 4 to about 11, and is preferably in the range of about 9 to about 10.

In another embodiment of the invention, a hydrotrope comprising the above-described alkyl polyglycoside combined with an amphoteric surfactant, in a percent actives ratio of about 1:1, is added to an aqueous liquid cleaning composition. For purposes of the present invention, the preferred amphoteric surfactant to be used is a substituted coco imidazoline dicarboxylate. The surfactant mixture is generally added to the aqueous liquid cleaning composition in an amount of from about 0.1 to about 10 weight percent, and preferably from about 1 to about 5 weight percent, based on the weight of the aqueous liquid cleaning composition. The amount used in a given aqueous liquid cleaning composition depends, of course, on the type of cleaning composition, i.e., neutral, general purpose, degreasing or heavy duty degreasing cleaning composition. The pH of the surfactant mixture employed in the aqueous liquid cleaning composition is in the range of from about 4 to about 11, and preferably in the range of about 9 to about 10.

In yet another embodiment of the present invention, there is provided an aqueous liquid cleaning composition comprising:

(a) water, (b) a hydrotrope comprising an amphoteric surfactant having general formula II

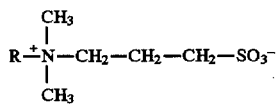

(II)

wherein R is a $C_{8-18}$ alkyl group or having the general formula III

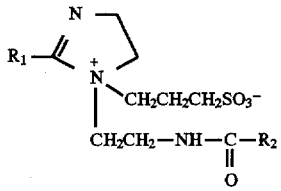

(III)

wherein each of $R_1$ and $R_2$ is a $C_8$–$C_{18}$ alkyl group, combined with an alkyl polyglycoside having the general formula III $$R_7O(Z)_a \quad \text{(III)}$$

wherein $R_7$ is a monovalent organic radical having from about 6 to about 30 carbon atoms; Z is saccharide residue having 5 or 6 carbon atoms; a is a number having a value from 1 to about 6, in a percent actives ratio of about 1:1, and (c) a builder.

The following amphoteric surfactants may also be employed in accordance with the present invention:

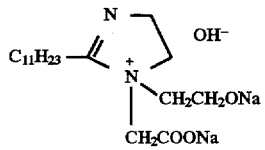

Miranol ® CM

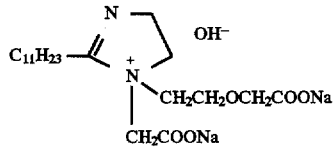

Miranol ® C2M

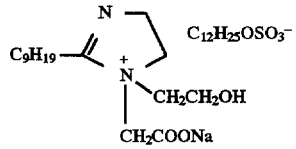

Miranol ® MSA

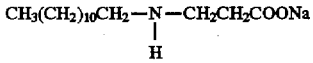

Deriphat ® 115 wherein each of $R_1$ and $R_2$ is a $C_8$–$C_{18}$ alkyl group.

The detergent component which probably has the greatest effect on the hydrotrope mixture is the builder. Some of the most common builders include the phosphates, such as sodium tripolyphosphate (STPP), tetrasodium pyrophosphate (TSPP), tetra potassium pyrophosphate (TKPP) and trisodium phosphate (TSP). The use of phosphates in detergents is banned in many parts of the U.S. for environmental reasons. Other types of builders include the citrates, the carbonates, the zeolites, the silicates and the polycarboxylate salts such as salts of nitrilotriacetic acid, and ethylene diamine tetraacetic acid (EDTA).

Other components which are optionally present in the aqueous liquid cleaning composition of the present invention include fillers, anti-redeposition agents, perfumes, corrosion inhibitors, pH adjusters or buffers, dyes or colorings, optical brighteners, foam control agents, bleaches, opacifiers and stabilizers.

In a particularly embodiment of the invention, the surfactant mixture employed in the detergent composition has a pH in the range of from about 4 to about 11, and preferably from about 9 to about 10.

The practice of this invention may be further appreciated by consideration of the following, non-limiting, working examples, and the benefits of the invention may be further appreciated by reference to the comparison examples. However, the invention is in no way limited by these examples.

EXAMPLES

Four liquid cleaning detergents: general purpose; neutral; degreaser; heavy duty degreaser were prepared in 1000 gram batches of each detergent. 90 grams of each detergent were then poured into 4 oz. jars having a magnetic bar therein. The detergents were then heated to about 55° C. until the detergent clouded. Various hydrotropes or surfactants with hydrotroping properties were then titrated into the detergents until they cleared. Listed below are the results obtained.

EXAMPLE 1

| General Purpose Cleaner | WT % |
|---|---|
| Sodium Metasilicate Pentahydrate | 5.0 |
| Tetrasodium EDTA (40%) | 2.0 |
| Nonyl phenol ethoxylate-9 mole | 3.0 |
| Hydrotrope/Surfactant | (see Table I) |
| Water | q.s. to 100% |

The following surfactants or hydrotropes were added in varying amounts to the general purpose cleaning composition in order to determine the amount needed to clear the cleaning composition at a temperature of about 50° C. The results are listed in both Table I.

TABLE I

| Sample | Type | grams needed to clear soln. | g. Actives | % compared to SXS |
|---|---|---|---|---|
| C1 | SXS | 3.30 | 1.32 | — |
| C2 | FBS | 1.25 | 0.50 | 38 |
| C3 | 225 | 1.30 | 0.91 | 69 |
| C4 | 325 | 2.20 | 1.10 | 83 |
| C5 | 425 | 2.64 | 1.32 | 100 |
| S1 | FBS/225 | 1.16 | 0.59 | 45 |
| S2 | FBS/325 | 1.36 | 0.60 | 45 |
| 53 | FBS/425 | 1.35 | 0.58 | 44 |
| 54 | FBS/625 | 1.72 | 0.76 | 58 |

SXS = sodium xylene sulfonate having 40% actives
FBS = Miranol ® FBS having 40% actives
225 = Glucopon ™ having 70% actives
325 = APG ® 325 having 50% actives
425 = Glucopon ™ 425 having 50% actives
625 = Glucopon ™ 625 having 50% actives
FBS/(APG) = mixed in ratio of about 1:1% actives

EXAMPLE 2

| Degreaser Cleaner | WT % |
|---|---|
| Sodium Metasilcate Pentahydrate | 5.0 |
| Tetrasodium EDTA (40%) | 2.0 |

-continued

| Degreaser Cleaner | WT % |
|---|---|
| Nonyl phenol ethoxylate-9 mole | 3.0 |
| NaOH (50%) | 2.0 |
| Propylene Glycol nButyl Ether | 3.0 |
| Hydrotrope/Surfactant | (see Table II) |
| Water | q.s. to 100% |

The following hydrotropes or surfactants were added in varying amounts to the cleaning composition in order to determine the amount needed to clear the cleaning composition at a temperature of about 50° C. The results are listed in both Table II.

TABLE II

| Sample | Type | grams needed to clear soln. | % Actives | % compared to SXS |
|---|---|---|---|---|
| C1 | SXS | 8.35 | 3.34 | — |
| C2 | FBS | 3.80 | 1.52 | 46 |
| C3 | 225 | 5.25 | 3.68 | 110 |
| C4 | 325 | 9.12 | 4.56 | 136 |
| C5 | 425 | 9.35 | 4.68 | 140 |
| S1 | FBS/225 | 4.24 | 2.16 | 65 |
| S2 | FBS/325 | 5.28 | 2.34 | 70 |
| S3 | FBS/425 | 5.30 | 2.35 | 70 |
| S4 | FBS/625 | 5.90 | 2.62 | 78 |

SXS = sodium xylene sulfonate having 40% actives
FBS = Miranol ® FBS having 40% actives
225 = Glucopon ™ 225 having 70% actives
325 = APG ® 325 having 50% actives
425 = Glucopon ™ 425 having 50% actives
625 = Glucopon ™ 625 having 50% actives
FBS/(APG) = mixed in ratio of about 1:1% actives

EXAMPLE 3

| Neutral Cleaner | WT % |
|---|---|
| Tetrasodium EDTA (40%) | 1.0 |
| Nonyl phenol ethoxylate-9 mole | 1.5 |
| Nonyl phenol ethoxylate-6 mole | 1.5 |
| Hydrotrope/Surfactant | (see Table III) |
| Water | q.s. to 100% |

The following hydrotropes or surfactants were added in varying amounts to the cleaning composition in order to determine the amount needed to clear the cleaning composition at a temperature of about 50° C. The results are listed in both Table III.

TABLE III

| Sample | Type | grams needed to clear soln. | % Actives | % compared to SXS |
|---|---|---|---|---|
| C1 | SXS | 5.60 | 2.24 | — |
| C2 | FBS | 0.60 | 0.24 | 11 |
| C3 | 225 | 2.60 | 1.82 | 81 |
| C4 | 425 | 2.70 | 1.35 | 60 |
| S1 | FBS/225 | 1.20 | 0.61 | 27 |
| S2 | FBS/325 | 1.40 | 0.62 | 28 |
| S3 | FBS/425 | 1.52 | 0.67 | 30 |

SXS = sodium xylene sulfonate having 40% actives
FBS = Miranol ® FBS having 40% actives
225 = Glucopon ™ 225 having 70% actives
425 = Glucopon ™ 425 having 50% actives
FBS/(APG) = mixed in ratio of about 1:1% actives

EXAMPLE 4

| Heavy Duty Degreaser Cleaner | WT % |
|---|---|
| Tetrasodium EDTA (40%) | 7.0 |
| Nonyl phenol ethoxylate-9 mole | 3.0 |
| KOH (45%) | 18.0 |
| Sodium Lauryl Sulfonate (40%) | 2.0 |
| Ethylene Glycol nButyl Ether | 4.0 |
| Hydrotrope/Surfactant | (see Table IV) |
| Water | q.s. to 100% |

The following hydrotropes or surfactants were added in varying amounts to the cleaning composition in order to determine the amount needed to clear the cleaning composition at a temperature of about 50° C. The results are listed in both Table IV.

TABLE IV

| Sample | Type | grams needed to clear soln. | % Actives | % compared to SXS |
|---|---|---|---|---|
| C1 | SXS | 7.58 | 3.03 | — |
| C2 | FBS | 5.98 | 2.40 | 80 |
| C3 | 225 | 4.57 | 3.20 | 106 |
| C4 | 325 | 7.70 | 3.85 | 127 |
| C5 | 425 | 9.35 | 4.68 | 128 |
| C6 | 625 | 10.70 | 5.28 | 174 |
| S1 | FBS/225 | 4.88 | 2.48 | 82 |
| S2 | FBS/325 | 5.82 | 2.58 | 85 |
| S3 | FBS/425 | 5.90 | 2.62 | 86 |
| S4 | FBS/625 | 6.15 | 2.73 | 90 |

SXS = sodium xylene sulfonate having 40% actives
FBS = Miranol ® FBS having 40% actives
225 = Glucopon ™ 225 having 70% actives
325 = APG ® 325 having 50% actives
425 = Glucopon ™ 425 having 50% actives
625 = Glucopon ™ 625 having 50% actives
FBS/(APG) = mixed in ratio of about 1:1% actives The results show that by combining an alkyl polyglycoside with an amphoteric surfactant, such as a substituted coco imidazoline dicarboxylate, in a percent actives ratio of about 1:1, a synergism occurs between the alkyl polyglycoside and the amphoteric surfactant which enables a highly effective hydrotrope to be formed. As can be seen from the results, a 1:1% actives ratio of alkyl polyglycoside to amphoteric surfactant is more effective than the commonly used sodium xylene sulfonate, and about equally as effective as the substantially more expensive amphoteric surfactant (C2) employed alone. A surfactant mixture comprising alkyl polyglycoside with an amphoteric surfactant requires less total actives to produce a clear solution, as compared to using an expensive amphoteric alone.

The cleaning ability of the surfactants and blends thereof were also evaluated according to the following Gardner Abrasion procedure:

Preparing the Tiles (1) linoleum tiles were cut to template size,
(2) tiles were then washed to remove dirt, oil or grease and allowed to dry,
(3) the tiles were then soiled on oven trays using a small paint brush by smoothing prepared ASTM A3 soil on the tiles,
(4) the soiled tiles were then placed in a 100° C. oven for about 20 minutes,
(5) the tiles were then removed and allowed to air dry in a hood for 2 hours.

Preparing the Solutions

The cleaning solutions were prepared according to Examples 1–4. The solutions were then diluted to a 10% concentration.

Running the Gardner Apparatus (1) 4 tiles were randomly selected and marked for the test cleaner to be used on them.
(2) a sponge was moistened and placed in a holder and 2 tiles were placed in a template,
(3) 200 mls of the test solution were placed into the template and soaked for 1 min,
(4) the Gardner Apparatus was turned on and reset to 0,
(5) the Gardner Apparatus was run for 40 cycles with stopping and rotating of the tiles after each 10 strokes,
(6) the tiles were then rinsed for a few seconds with deionized water and allowed to air dry.

The tiles were then measured for reflectance using a Lab-Scan (i.e. photometer capable of accurately measuring changes in substrate reflectance)

Determination of % Soil Removed

RI=Initial reflectance of clean white tile.

RF=Reflectance of cleaned tile using cleaning solution.

$RH_2O$=Reflectance of cleaned tile using water only $$\% \text{ Soil Reduction} = \frac{RF - RH_2O}{RI - RH_2O} \times 100$$

TABLE V

| Sample | Type | grams added to clear soln. | % Actives |
|---|---|---|---|
| C1 | SXS | 3.25 | 1.30 |
| C2 | FBS | 3.25 | 1.30 |
| C3 | 225 | 1.86 | 1.30 |
| C4 | 325 | 2.60 | 1.30 |
| C5 | 425 | 2.60 | 1.30 |
| S1 | FBS/225 | 2.55 | 1.30 |
| S2 | FBS/325 | 2.93 | 1.30 |
| S3 | FBS/425 | 2.93 | 1.30 |
| S4 | FBS/625 | 2.93 | 1.30 |

SXS = sodium xylene sulfonate having 40% actives
FBS = Miranol ® FBS having 40% actives
225 = Glucopon ™ 225 having 70% actives
325 = APG ® 325 having 50% actives
425 = Glucopon ™ 425 having 50% actives
625 = Glucopon ™ 625 having 50% actives
FBS/(APG) = mixed in ratio of about 1:1% actives The results of the Gardner Abrasion procedure are shown in FIG. 1. There it can be seen that all of the hydrotropes, with the exception of SXS performed about equally as effectively in terms of cleaning ability (i.e. % soil removed). Thus, by employing the hydrotrope of the present invention, a liquid detergent composition having both enhanced hydrotroping and cleaning properties can be obtained.

It will be recognized by those skilled in the art that changes may be made to the above-described invention without departing from the broad inventive concepts thereof. It is understood, therefore, that this invention is not limited to the particular embodiment disclosed, but it is intended to cover all modifications which are within the scope and spirit of the invention as defined by the appended claims.

What is claimed is:

1. A process for making a hydrotrope consisting essentially of combining an alkyl polyglycoside having the formula I:

$$R_1O(Z)_a \qquad (I)$$

wherein $R_1$ is a monovalent organic radical having from about 6 to about 30 carbon atoms; Z is saccharide residue having 5 or 6 carbon atoms; a is a number having a value from 1 to about 6 and an amphoteric surfactant, in a percent actives ratio of about 1:1.

2. The process of claim 1 wherein the amphoteric surfactant is selected from the group consisting of an N-alkyl beta-alanine, an amino betaine, an amido betaine, an imidazoline betaine, an amino oxide, and mixtures thereof.

3. The process of claim 2 wherein the amphoteric surfactant is an N-alkyl beta-alanine.

4. The process of claim 2 wherein the amphoteric surfactant is an amino betaine.

5. The process of claim 2 wherein the amphoteric surfactant is an imidazoline betaine.

6. The process of claim 5 wherein the imidazoline betaine is a substituted coco-imidazoline dicarboxylate.

7. A process for reducing viscosity and preventing phase separation in an aqueous liquid detergent composition comprising adding to the aqueous liquid detergent composition from about 0.1 to about 10% by weight, based on the weight of the composition, of a hydrotrope, the hydrotrope consisting essentially of a mixture of an alkyl polyglycoside having the formula I:

$$R_1O(Z)_a \qquad (I)$$

wherein $R_1$ is a monovalent organic radical having from about 6 to about 30 carbon atoms; Z is saccharide residue having 5 or 6 carbon atoms; a is a number having a value from 1 to about 6 and an amphoteric surfactant, in a percent actives ratio of about 1:1.

8. The process of claim 7 wherein the amphoteric surfactant is selected from the group consisting of an N-alkyl beta-alanine, an amino betaine, an amido betaine, an imidazoline betaine, an amino oxide, and mixtures thereof.

9. The process of claim 8 wherein the amphoteric surfactant is an N-alkyl beta-alanine.

10. The process of claim 8 wherein the amphoteric surfactant is an amino betaine.

11. The process of claim 8 wherein the amphoteric surfactant is an imidazoline betaine.

12. The process of claim 11 wherein the imidazoline betaine is a substituted coco-imidazoline dicarboxylate.

13. A liquid cleaning composition comprising water and a hydrotrope, the hydrotrope consisting essentially of an amphoteric surfactant combined with an alkyl polyglycoside having the formula I:

$$R_1O(Z)_a \qquad (I)$$

wherein $R_1$ is a monovalent organic radical having from about 6 to about 30 carbon atoms; Z is saccharide residue having 5 or 6 carbon atoms; a is a number having a value from 1 to about 6, in a percent actives ratio of about 1:1.

14. The composition of claim 13 wherein the amphoteric surfactant is selected from the group consisting of an N-alkyl beta-alanine, an amino betaine, an amido betaine, an imidazoline betaine, an amino oxide, and mixtures thereof.

15. The composition of claim 14 wherein the amphoteric surfactant is an N-alkyl beta-alanine.

16. The composition of claim 14 wherein the amphoteric surfactant is an amino betaine.

17. The composition of claim 14 wherein the amphoteric surfactant is an imidazoline betaine.

18. The composition of claim 17 wherein the imidazoline betaine is a substituted coco-imidazoline dicarboxylate.

19. The composition of claim 13 further comprising a builder component.

20. The composition of claim 13 wherein the hydrotrope is present in the composition in an amount of from about 0.1 to about 10% by weight, based on the weight of the composition.

* * * * *